US007506505B2

(12) United States Patent
Fushimi

(10) Patent No.: US 7,506,505 B2
(45) Date of Patent: Mar. 24, 2009

(54) HYDRAULIC DRIVING DEVICE FOR OPERATING MACHINE

(75) Inventor: Kazunori Fushimi, Tokyo (JP)

(73) Assignee: Kayaba Industry Co., Ltd., Tokyo (JP)

( * ) Notice: Subject to any disclaimer, the term of this patent is extended or adjusted under 35 U.S.C. 154(b) by 396 days.

(21) Appl. No.: 10/590,203

(22) PCT Filed: Jun. 24, 2005

(86) PCT No.: PCT/JP2005/012143

§ 371 (c)(1),
(2), (4) Date: Aug. 22, 2006

(87) PCT Pub. No.: WO2006/137170

PCT Pub. Date: Dec. 28, 2006

(65) Prior Publication Data

US 2008/0223030 A1 Sep. 18, 2008

(51) Int. Cl.
*B66F 9/22* (2006.01)
*F15B 11/04* (2006.01)
*F15B 21/08* (2006.01)

(52) U.S. Cl. ..... 60/368; 60/459; 701/50

(58) Field of Classification Search ..... 60/368, 60/459, 468; 91/358 R, 444; 701/50
See application file for complete search history.

(56) References Cited

U.S. PATENT DOCUMENTS 5,007,543 A * 4/1991 Cooke ..... 212/285

FOREIGN PATENT DOCUMENTS

| | | |
|---|---|---|
| DE | 199 18 039 | 10/2000 |
| DE | 100 21 821 | 11/2001 |
| JP | 2000-081905 | 3/2000 |

* cited by examiner

*Primary Examiner*—Thomas E Lazo
(74) *Attorney, Agent, or Firm*—Rabin & Berdo, P.C.

(57) ABSTRACT

In a hydraulic driving device for an operating machine, when an output value of an operating device is in a first predetermined range, a pump is stopped and each of an open and closed valve and a hydraulic control valve is closed. When the output value goes beyond the first predetermined range, the pump is started and the open and closed valve is opened. When the output value goes beyond a second range greater than the first predetermined range, the hydraulic control valve is opened to supply a hydraulic fluid to an actuator.

2 Claims, 4 Drawing Sheets

HYDRAULIC DRIVING DEVICE FOR OPERATING MACHINE

BACKGROUND OF THE INVENTION

1. Field of the Invention

The present invention relates to a hydraulic driving device for an operating machine, and in particular, to a hydraulic driving device for an operating machine provided with a hydraulic control valve that controls an oil pressure in accordance with an operation of an operator.

2. Description of the Related Art

An operating machine, for instance, a battery forklift is provided with an electric pump as a hydraulic power source to move a fork included therein vertically. A hydraulic fluid supplied from the electric pump is supplied to a hydraulic control valve (for instance, a proportional solenoid valve). A supply state of the hydraulic fluid supplied to the hydraulic control valve is controlled by an unloading valve. The hydraulic control valve adjusts an oil pressure of the supplied hydraulic fluid to an oil pressure in accordance with an operation of an operator, for instance, an operation of a joystick and supplies the adjusted oil pressure to an actuator that moves the fork.

In such a battery forklift, when the joystick is not operated, a power source of a motor to drive the electric pump is turned off so that consumption of power accumulated in a battery is suppressed. This time, each of the unloading valve and the hydraulic control valve is controlled, thereby producing a state of closing an oil passage through which the hydraulic fluid between the electric pump and the actuator flows.

When an operation command in accordance with the operation of the joystick is inputted in the state as described above, starting the motor of the electric pump and opening the unloading valve and the hydraulic control valve are performed simultaneously. Consequently, a timing in which the oil pressure of the hydraulic fluid from the electric pump is exerted on the hydraulic control valve and a timing in which the hydraulic control valve moves a spool thereof to adjust the oil pressure of the supplied hydraulic fluid to a predetermined oil pressure occur simultaneously. For this reason, the oil pressure of the hydraulic fluid discharged from the electric pump is directly exerted on the actuator of the fork to generate a shock.

Japanese Patent Laid-Open Publication No. 2000-81905 discloses that, so as to suppress the shock, the hydraulic control valve is controlled in such a manner that an oil pressure is gradually increased. In this case, however, a change of the oil pressure in response to the operation of the joystick is slower and responsiveness thereof is deteriorated.

The present invention, in view of the foregoing problems, has an object of providing a hydraulic control device for an operating machine that suppresses a shock caused by hydraulic variations at the time of starting the pump.

SUMMARY OF THE INVENTION

According to the present invention, a hydraulic driving device for an operating machine comprises an actuator, a pump to discharge a hydraulic fluid by driving a motor therein, an oil passage to introduce the hydraulic fluid discharged from the pump to the actuator, a hydraulic control valve provided in the oil passage to control an oil pressure of the hydraulic fluid that is introduced to the actuator, an open and closed valve (unloading valve) to control opening and closing of the oil passage between the pump and the hydraulic control valve, an operating device with which a driver operates the actuator, and a controller adapted to control an opening of the hydraulic control valve and the open and closed valve in accordance with an output value of the operating device, wherein the controller is adapted to stop the pump, and close the open and closed valve and close the hydraulic control valve when the output value of the operating device is within a first predetermined range, start the pump and open the open and closed valve when the output value goes beyond the first predetermined range, and open the hydraulic control valve to supply the hydraulic fluid to the actuator when the output value goes beyond a second range greater than the first predetermined range. According to the arrangement as described above, the hydraulic fluid from the pump is supplied to the hydraulic control valve in advance to exert an oil pressure of the hydraulic fluid to the hydraulic control valve, and thereafter, the hydraulic control valve is opened. Therefore, a shock generated in the actuator at the time of starting the pump can be prevented.

BEST MODES FOR CARRYING OUT THE INVENTION

Figure 1:
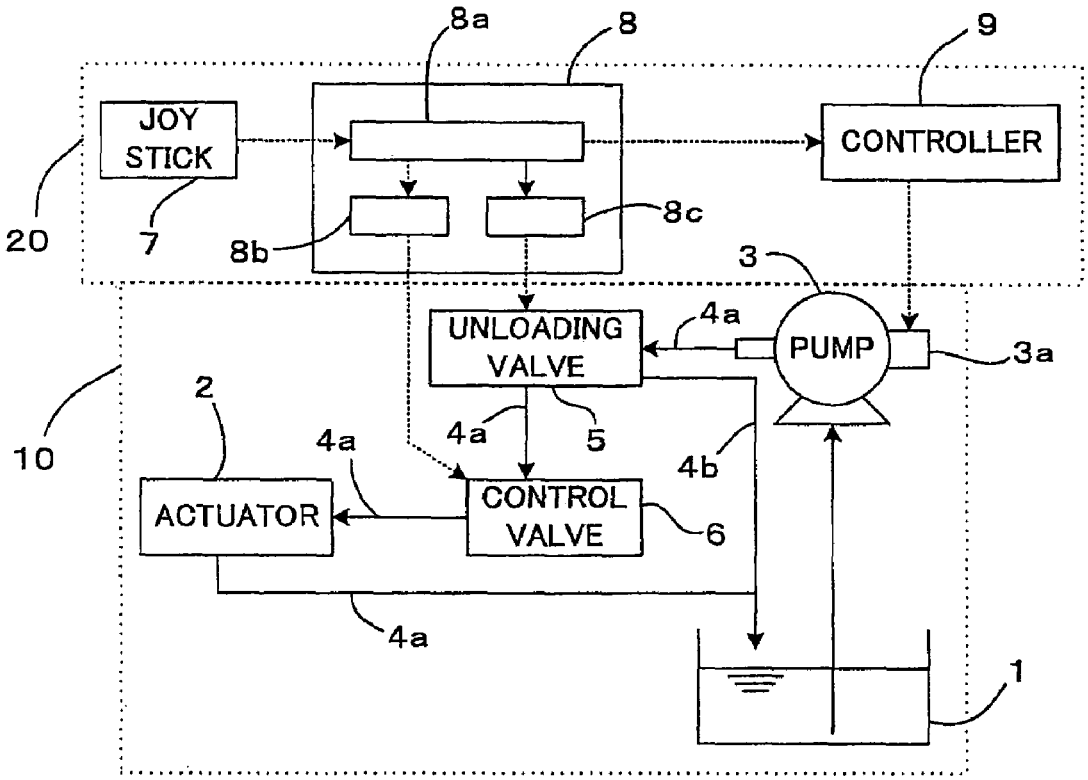
FIG. 1 is a diagram illustrating an arrangement of a first embodiment.

As shown in FIG. 1, a hydraulic driving device for an operating machine according to a first embodiment of the present invention is, for instance, provided with a hydraulic drive unit 10 to move a fork of a forklift and a control unit 20 to control the hydraulic drive unit 10.

The hydraulic drive unit 10 includes a hydraulic fluid tank 1 to store a hydraulic fluid, an actuator 2 to move, for instance, the fork of the forklift (not shown) and an electric pump 3 that sucks in the hydraulic fluid from the hydraulic fluid tank 1 and discharges the hydraulic fluid for supplying the hydraulic fluid to the actuator 2 through an oil passage 4*a*.

An amount of the hydraulic fluid discharged by the electric pump 3 is controlled in accordance with a rotation of an electric motor 3*a* to drive the electric pump 3. An unloading valve 5 is provided in the oil passage 4*a* at a downstream side of the electric pump 3 to open the oil passage 4*a*. An oil passage 4*b* is connected between the unloaded valve 5 and the tank 1 to directly supply the hydraulic fluid from the unloaded valve 5 to the tank 1.

When a control signal of ON from a controller 8 to be described hereinafter is inputted to the unloading valve 5, the unloading valve 5 closes the oil passage 4*b* and opens the oil passage 4*a* to supply the hydraulic fluid supplied from the electric pump 3 to a hydraulic control valve 6. When the control signal of OFF is inputted to the unloading valve 5, the unloading valve 5 opens the oil passage 4*b* and closes the oil passage 4*a* to prevent the hydraulic fluid from flowing into the hydraulic control valve 6 and return the hydraulic fluid to the tank 1 via the oil passage 4*b*. The hydraulic control valve 6 is formed of, for example, a proportional solenoid valve and adjusts an oil pressure of the hydraulic fluid supplied from the electric pump 3 to a predetermined oil pressure to supply the hydraulic fluid to the actuator 2.

The control unit 20 includes a joystick lever (hereinafter referred to as joystick) 7 that is operated for movement of the fork by a forklift driver and outputs a voltage signal in accordance with an amount of detection thereof, a controller 8 to which the voltage signal from the joystick 7 is inputted to control the unloading valve 5 or the hydraulic control valve 6 and a motor controller 9 to control the electric motor 3*a*of the electric pump 3. The controller 8 is equipped with a CPU 8*a*.

The CPU 8*a* calculates a target current necessary for a cargo handling work on the basis of the voltage signal inputted from the joystick 7. The CPU 8*a* outputs the calculated target current to a hydraulic control valve control unit 8*b*, an unloading valve control unit 8*c* and a motor controller 9.

Operations of the first embodiment will be described as follows.

When the driver operates the joystick 7, a voltage in accordance with the operation amount is inputted as an output signal from the joystick 7 to the controller 8. The controller 8 calculates a target current based on the inputted voltage signal, and the hydraulic control valve control unit 8*b* controls the hydraulic control valve 6 based on the calculated target current in such a manner that an oil pressure of the hydraulic fluid to be supplied to the actuator 2 becomes a predetermined oil pressure. Further, the unloading valve control unit 8*c* controls opening and closing of the unloading valve 5 based on the calculated target current. Furthermore, the motor controller 9 controls an operation of the electric motor 3*a* to provide a discharge amount of the electric pump 3 in accordance with the target current. The oil pressure in accordance with the operation amount of the joystick 7 that is thus operated by the driver is supplied to the actuator 2, and therefore, the fork can be moved as intended by the driver.

Figure 2:
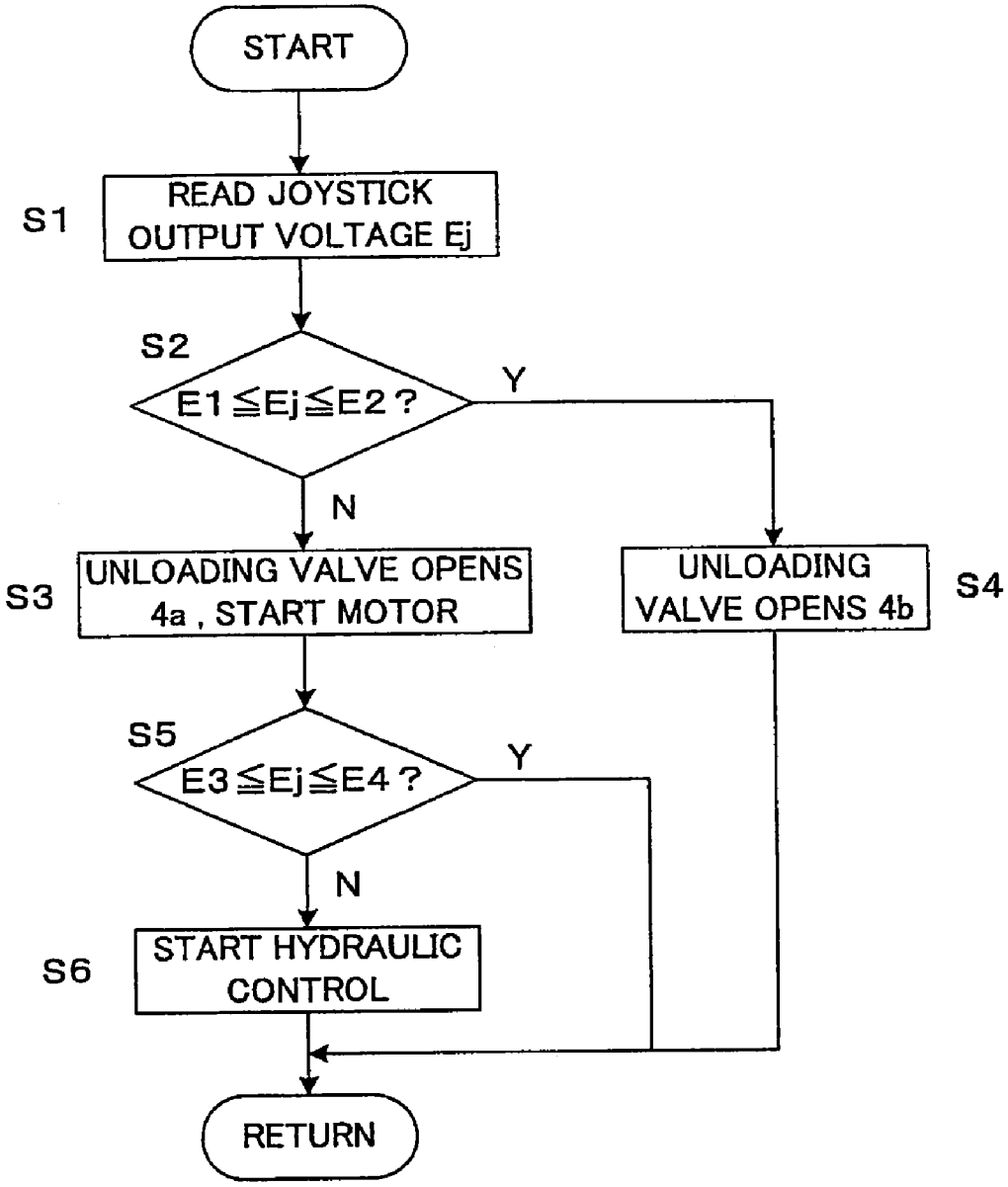
FIG. 2 is a flow chart for explaining control contents of a controller.

FIG. 2 is a flow chart explaining a hydraulic control at the time of starting the electric pump in the first embodiment, which is performed by the controller 8. The hydraulic control to be described hereinafter is performed at the time when the electric pump 3 is started according to the operation of the joystick 7. When the electric pump 3 is stopped, the joystick 7 is in a neutral state, and the hydraulic control valve 6 closes the oil passage 4*a* and the unloading valve 5 closes the oil passage 4*a* and opens the oil passage 4*b*.

First, in step 1 (S1 in FIG. 2, hereinafter the same), an output voltage Ej of the joystick 7 is read. In step 2, the output voltage Ej is compared to a predetermined voltage for determining whether a predetermined condition is satisfied or not. In the first embodiment, it is determined whether the output voltage Ej is in a first predetermined range of being equal to or more than a predetermined voltage E1 and also equal to or less than a predetermined voltage E2 or not. The first predetermined range is a range of the output voltage by which the controller 8 determines that the joystick 7 is in the neutral position.

When the output voltage Ej satisfies the condition, the unloading valve 5 closes the oil passage 4*a* in step 4 and the control is terminated. When the output voltage Ej does not satisfy the condition, the process goes to step 3. In step 3, the electric motor 3*a* to drive the electric pump 3 is started and the unloading valve 5 opens the oil passage 4*a*.

Figure 3:
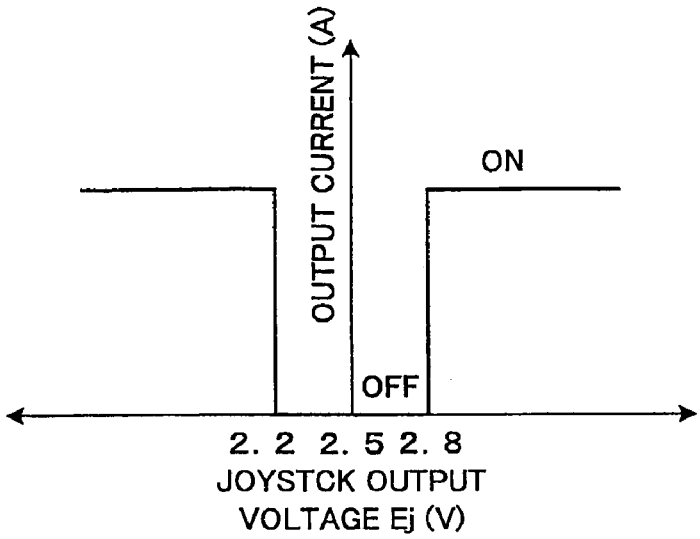
FIG. 3 is a drive table for an unloading valve.

FIG. 3 is a drive table for the unloading valve 5 illustrating an output voltage Ej of the joystick 7 and an open and closed state of the unloading valve 5. A method to set the predetermined voltages E1, E2 will be described with reference to FIG. 3.

In FIG. 3, threshold voltages in which the unloading valve 5 is switched from off (a state when the oil passage 4*a* is closed) to on (a state when the oil passage 4*a* is opened) are the predetermined voltages E1, E2. Herein, an output voltage Ej in a neutral state of the joystick 7 shows, for instance, 2.5 V (volts). When a dead zone (for instance, ±0.3 V) is set to the output voltage Ej in the neutral position, the predetermined voltage E1 is a lower limit value thereof and the predetermined voltage E2 is an upper limit value thereof. That is, the predetermined voltage E1 of the lower limit value is 2.2 V and the predetermined voltage E2 of the upper limit value is 2.8 V. Therefore, the unloading valve 5 opens the oil passage 4*a* and closes the oil passage 4*b* when an output voltage Ej of the joystick 7 is equal to or less than 2.2 V or equal to or more than 2.8 V.

As described above, the dead zone is provided to the output voltage Ej produced when the joystick 7 is in the neutral state, and each of the lower limit value and the upper limit value is set as each of the predetermined voltages E1, E2. As a result, even when an actual output voltage Ej in the neutral position of the joystick 7 deviates from the output voltage Ej (2.5 V) in the neutral position due to variations in components of the joystick 7, the deviation is permissible. According to the arrangement, even when component variations occur, in the neutral state of the joystick 7 the unloading valve 5 is not positioned in a state of opening the oil passage 4*a*, thus preventing the electric motor 3*a* from being operated by accident.

In step 5 following step 3, it is determined whether the read output voltage Ej is in a second predetermined range of being equal to or more than a predetermined voltage E3 and equal to or less than a predetermined voltage E4 or not. Herein, the second predetermined range is set to be greater than the first predetermined range as described hereinafter. When the output voltage Ej satisfies the condition, the control is terminated. When the condition is not satisfied, the process goes to step 6, wherein a hydraulic control of the hydraulic fluid is performed by the hydraulic control valve 6.

Figure 4:
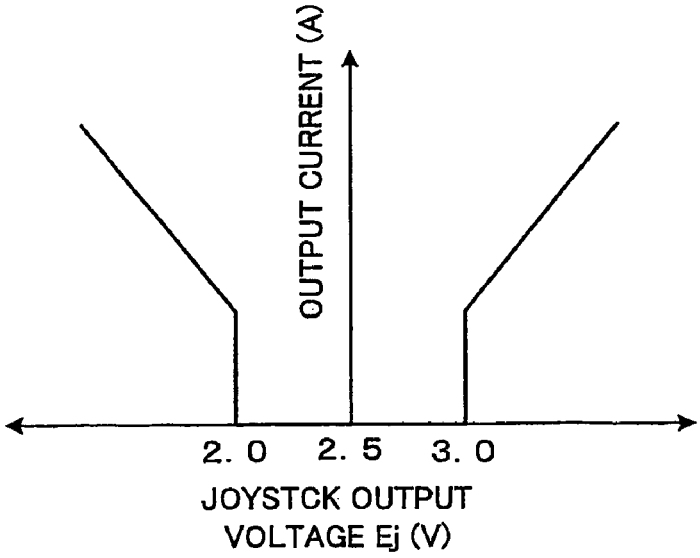
FIG. 4 is a drive table for a hydraulic control valve.

FIG. 4 is a drive table for the hydraulic control valve 6 illustrating an output voltage Ej of the joystick 7 and a hydraulic control state of the hydraulic control valve 6. Settings of the predetermined voltages E3, E4 will be described with reference to FIG. 4.

The predetermined voltages E3, E4 are threshold voltages where the hydraulic control valve 6 is switched from a closed state of the oil passage 4*a* to an open state of the oil passage 4*a* to start a hydraulic control of the hydraulic fluid. For instance, when a dead zone of ±0.5 V is set to an output voltage Ej (target value, 2.5 V) in the neutral state of the joystick 7, the predetermined voltage E3 is a lower limit value thereof and the predetermined voltage E4 is an upper limit value thereof. That is, E3 is equal to 2.0 V and E4 is equal to 3.0 V. Therefore, when the output voltage of the joystick 7 is equal to or lower than 2.0 V or equal to or more than 3.0 V, the hydraulic control valve 6 opens to start a hydraulic control. A dead zone greater than the dead zone (±0.3 V) of the unloading valve 5 is provided to the output voltage Ej in the neutral state of the joystick 7, whereby after the unloading valve 5 has opened the oil passage 4*a* and has closed the oil passage 4*b*, the hydraulic control of the hydraulic control valve 6 can securely be started.

In step 6, the hydraulic control valve 6 is opened to perform a hydraulic control of the hydraulic fluid that is supplied to the actuator 2. The hydraulic control valve 6 adjusts an oil pressure s1 of the hydraulic fluid supplied from the electric pump 3 in such a manner that the oil pressure s1 corresponds to an oil pressure p1 in accordance with an operation amount of the joystick 7. The hydraulic fluid the oil pressure of which is adjusted to the oil pressure p1 is supplied to the actuator 2 to move the fork (not shown) as intended by the driver.

Figure 5:
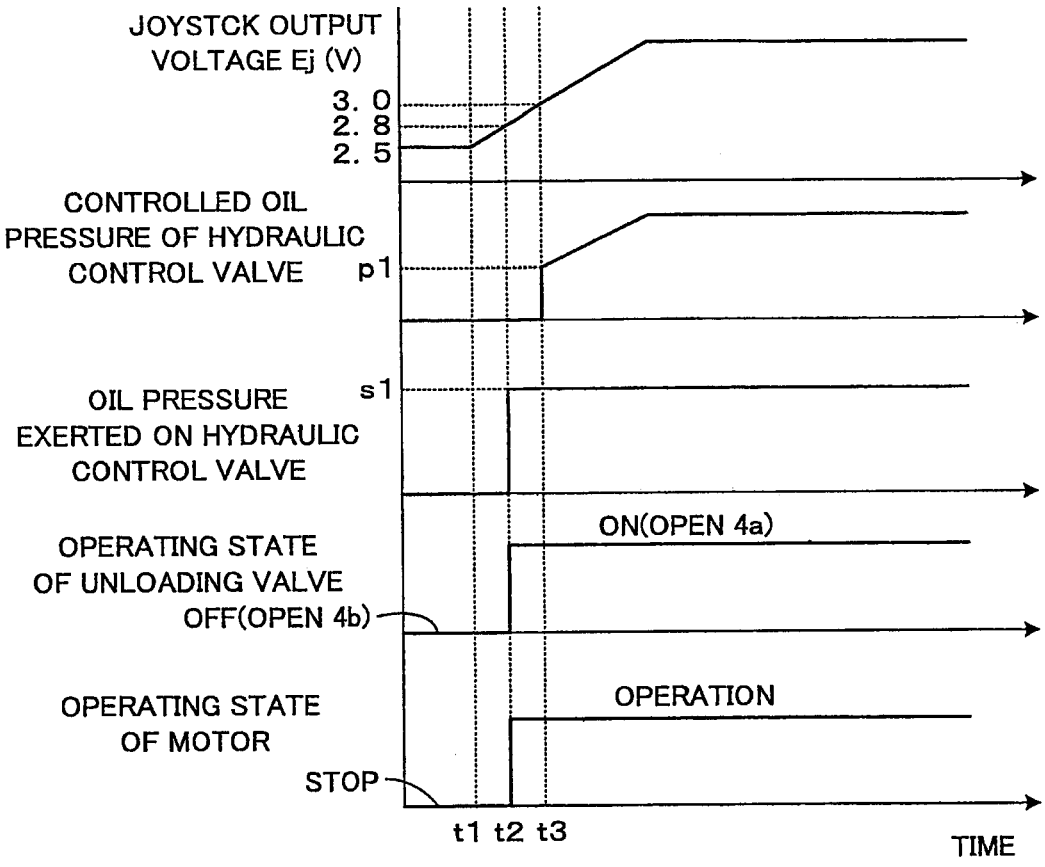
FIG. 5 is a timing chart illustrating an operating state of each of an electric motor, a hydraulic control valve and an unloading valve.

Operations will be described with reference to FIG. 5. FIG. 5 is a timing chart illustrating an operating state of each of the electric motor 3*a*, the unloading valve 5 and the hydraulic control valve 6 relative to each of output voltages Ej of the joystick 7. It is explained that in the timing chart, the joystick 7 is operated from the neutral state to a side where the output voltage Ej is increased.

Until time t1, the output voltage Ej of the joystick 7 is maintained to be an output voltage Ej (2.5 V) produced when the joystick 7 is in the neutral state, where the operation by the driver is not performed. Each of the unloading valve 5 and the hydraulic control valve 6 at this time is positioned in a state of opening the oil passage 4*b* and closing the oil passage 4*a*, and the electric motor 3*a* to drive the electric pump 3 is also stopped. In this state, an oil pressure of the hydraulic fluid exerting on the hydraulic control valve 6 corresponds to an atmospheric pressure.

At time t1, the operation of the joystick 7 is started to increase the output voltage Ej thereof. At time t2, when the output voltage Ej reaches a predetermined voltage E2 (2.8 V), the unloading valve 5 opens the oil passage 4*a* (ON state) and the electric motor 3*a* is started. In this state, the hydraulic control valve 6 still closes the oil passage 4*a*. However, the hydraulic fluid discharged from the electric pump 3 reaches the hydraulic control valve 6 through the unloading valve 5.

As the operation amount of the joystick 7 is further increased, the output voltage Ej is increased. At time t3, the output voltage Ej reaches a predetermined voltage E4. When the output voltage Ej reaches the predetermined voltage E4 (3.0 V), the hydraulic control valve 6 opens the oil passage 4*a* to adjust the oil pressure s1 of the hydraulic fluid exerted on the hydraulic control valve 6 to the predetermined oil pressure p1 to move a spool in the hydraulic control valve 6 in accordance with the operation amount of the joystick 7. The hydraulic fluid of which is adjusted to the predetermined oil pressure p1 is supplied to the actuator 2 for moving the fork. After that, a regular hydraulic control in accordance with the operation amount of the joystick 7 is performed.

As described above, in the present invention, when an output value of the joystick 7 is in the first predetermined range (2.5±0.3 V), the electric pump 3 is stopped, and the unloading valve 5 opens the oil passage 4*b*, closes the oil passage 4*a* and the hydraulic control valve 6 closes the oil passage 4*a*. When the output value goes beyond the first predetermined range (at time t2), the electric pump 3 is started and the unloading valve 5 opens the oil passage 4*a* and closes the oil passage 4*b*. When a second range greater than the first predetermined range is set and the output value goes beyond the second range (at time t3), the hydraulic control valve 6 opens the oil passage 4*a* to supply the hydraulic fluid to the actuator 2. Accordingly, when the hydraulic control valve 6 starts to be opened at time t3, the oil pressure s1 of the hydraulic fluid supplied from the electric pump 3 is already exerted on the hydraulic control valve 6. The hydraulic control valve 6 thus starts to be opened from the state where the oil pressure s1 is already exerted thereon, thereby preventing overshoot of the spool in the hydraulic control valve 6, and the pilot pressure to move the spool does not go beyond the predetermined oil pressure p1. For this reason, a shock at the actuator 2 is suppressed. Moreover, since the time between time t2 and time t3 is short, responsiveness of the joystick 7 is not deteriorated.

Additionally, an operating device by a driver is not limited to the joystick 7 but may include a device of a fingertip type or a lever type using a contact type/non-contact type potentiometer. Furthermore, the operating device may not be a device of the lever type but be a potentiometer or a controller to output an analog signal equivalent to the potentiometer.

In the above description, the present invention is described to take a vehicle, especially a forklift as an example. However, it is obvious that the present invention may be applied to an operating machine such as an industrial vehicle or a construction vehicle including the arrangement of the present embodiment.

INDUSTRIAL APPLICABILITY

A hydraulic driving device for a vehicle according to the present invention is applied to a vehicle provided with a hydraulic control valve on which a hydraulic fluid from a pump is directly exerted, whereby a shock produced at the time of starting the pump can be suppressed.

The invention claimed is:

1. A hydraulic driving device for an operating machine, comprising:

an actuator (2);

a pump (3) to discharge a hydraulic fluid by driving a motor therein;

an oil passage (4*a*) to introduce the hydraulic fluid discharged from the pump to the actuator;

a hydraulic control valve (6) provided in the oil passage to control an oil pressure of the hydraulic fluid that is introduced to the actuator;

an open and closed valve (5) to control opening and closing of the oil passage between the pump and the hydraulic control valve;

an operating device (7) with which a driver operates the actuator; and a controller (8) adapted to control an opening of the hydraulic control valve and the open and closed valve in accordance with an output value of the operating device, wherein:

the controller is adapted to:

stop the pump, and close the open and closed valve and the hydraulic control valve respectively when the output value of the operating device is in a first predetermined range (E1,E2);

start the pump and open the open and closed valve when the output value goes beyond the first predetermined range; and open the hydraulic control valve to supply the hydraulic fluid to the actuator when the output value goes beyond a second range (E3,E4); greater than the first predetermined range.

2. The hydraulic driving device according to claim 1, wherein:

the first predetermined range is set to include the output value produced when the operating device is in a neutral position; and the second range is set to include a value smaller than a minimum value of the first predetermined range and a value greater than a maximum value of the first predetermined range.

* * * * *